US008608379B2

(12) United States Patent
Madai et al.

(10) Patent No.: US 8,608,379 B2
(45) Date of Patent: Dec. 17, 2013

(54) MICROWAVABLE BAG WITH VALVE AND METHOD FOR THE FABRICATION THEREOF

(75) Inventors: Gyula Madai, Budapest (HU); Christian Caro, Triel/Siene (FR); Thomas Fischer, Burgdorf (CH); Franz Scheidl, Deutsch/Wagram (AT)

(73) Assignee: Mondi AG (AT)

( * ) Notice: Subject to any disclaimer, the term of this patent is extended or adjusted under 35 U.S.C. 154(b) by 137 days.

(21) Appl. No.: 12/988,361

(22) PCT Filed: Apr. 20, 2009

(86) PCT No.: PCT/EP2009/054643

§ 371 (c)(1), (2), (4) Date: Oct. 18, 2010

(87) PCT Pub. No.: WO2009/130177

PCT Pub. Date: Oct. 29, 2009

(65) Prior Publication Data

US 2011/0033134 A1 Feb. 10, 2011

(30) Foreign Application Priority Data

Apr. 22, 2008 (EP) ..... 08007727

(51) Int. Cl.
*B65D 30/24* (2006.01)
*B65D 33/16* (2006.01)
*B65D 33/01* (2006.01)

(52) U.S. Cl.
USPC ..... 383/45; 383/64; 383/100; 383/103; 383/63

(58) Field of Classification Search
USPC ..... 383/45, 64, 100, 103, 63
See application file for complete search history.

(56) References Cited

U.S. PATENT DOCUMENTS 3,085,737 A * 4/1963 Horton ..... 383/101
5,307,552 A * 5/1994 Dais et al. ..... 29/453

(Continued)

FOREIGN PATENT DOCUMENTS

EP 1 721 833 11/2006
GB 2458645 * 9/2009 ..... A44B 19/10

(Continued)

OTHER PUBLICATIONS

JP 2000-72156 Translation.*

(Continued)

*Primary Examiner* — Nathan J Newhouse
*Assistant Examiner* — Derek Battisti
(74) *Attorney, Agent, or Firm* — Ostrolenk Faber LLP

(57) ABSTRACT

In a reclosable bag (20) a zipper (Z) is provided on the inner surfaces (50) of the plastic film and the two parts of the zipper (Z) are fixed on the opposite inner surfaces (50) of the bag (20), wherein the zipper (Z) is connected to the inner surface (50) of the plastic film in such a manner that between the welded regions (12, 14) between the zipper (Z) and the inner surface (50) of the plastic film, recesses (15, 13) are left free in the longitudinal direction of the zipper (Z) to form a seal-free longitudinal channel and in the transverse direction of the zipper (Z) to produce free air or steam passage openings at defined distances between the zipper (Z) and the inner surface (50), through which openings a passage of steam is possible, wherein ends of the openings facing the interior (60) of the bag (20) are larger than ends of the openings facing the exterior (70) of the bag (20).

12 Claims, 6 Drawing Sheets

(56) References Cited

U.S. PATENT DOCUMENTS

| | | | | |
|---|---|---|---|---|
| 5,655,842 | A * | 8/1997 | Hagino | 383/101 |
| 5,934,806 | A * | 8/1999 | Tomic et al. | 383/63 |
| 6,132,780 | A * | 10/2000 | Archibald et al. | 426/106 |
| 6,594,872 | B2 * | 7/2003 | Cisek | 24/401 |
| 6,953,542 | B2 * | 10/2005 | Cisek | 264/210.2 |
| 2004/0069157 | A1 * | 4/2004 | Lin | 99/451 |
| 2007/0087096 | A1 * | 4/2007 | Mir | 426/415 |
| 2007/0297698 | A1 * | 12/2007 | Berich | 383/42 |
| 2008/0310771 | A1 * | 12/2008 | Dais et al. | 383/59 |
| 2008/0310776 | A1 * | 12/2008 | Turvey et al. | 383/105 |

FOREIGN PATENT DOCUMENTS

| | | | | |
|---|---|---|---|---|
| JP | 2000-72156 | | 3/2000 | |
| WO | WO2007097255 | * | 8/2007 | B65D 83/00 |

OTHER PUBLICATIONS

English Translation of International Search Report and Written Opinion.

* cited by examiner

MICROWAVABLE BAG WITH VALVE AND METHOD FOR THE FABRICATION THEREOF

CROSS-REFERENCE TO RELATED APPLICATION

The present application is a 35 U.S.C. §371 national phase conversion of PCT/EP2009/054643 filed Apr. 20, 2009, which claims benefit and priority of European Patent Application No. 08007727.4 filed Apr. 22, 2008, both incorporated herein in their entirety.

TECHNICAL FIELD

The invention relates to a reclosable bag, which is suitable for cooking food and which has a device for the escape of steam.

The invention further relates to a tool for making a connection between a zipper and an inner surface of a plastic film, which is intended as the bag wall of a bag.

A method for making a connection between a portion of a zipper and an inner surface of a plastic film which is intended as the bag wall of a bag.

BACKGROUND

Packages suitable for heating in a microwave are known, for example, from EP 661 219 A, WO 03/051745 A, WO 04/13015 A or EP 1 714 908 A.

In this case, the packages have valves of different type and shape.

The reclosability of the packages is usually provided by adhesive coatings in an edge zone of the package. However, even when the sealable coating is slightly contaminated, the package is no longer completely closable.

Further known from EP 1 721 833 A1 is a self-venting, reclosable bag in which one or more discontinuities are provided in a seal layer between the inner surface of the plastic film of the bag and a portion of the zipper. These discontinuities are described as a gap and allow hot air or steam to escape through them from the interior of the bag.

A bag having a device for the escape of steam is likewise further known from JP 2000-72156, wherein this bag has permanent openings between the inner surface of the plastic film of the bag and a portion of the zipper in the transverse direction to the zipper. These permanent openings are disclosed as channels having constant cross-section or constant width.

US 2004/0069157 A1 also discloses a device for the escape of steam in connection with a bag, wherein this device is disclosed in the present case by pseudo-closed gaps in a polymer layer of the film.

The solutions disclosed in connection with a zipper frequently prove to be problematical because the channels or gaps between the inner surface of the plastic film and a portion of the zipper are frequently laid through moisture and the so-called glass plate effect significantly impairs a reliable opening of these gaps or channels. The sufficiently known glass plate effect substantially involves two glass plates between which moisture enters being barely able to be separated from one another, or only with expenditure of extreme force. This effect is particularly important in the steam cooking of food in a bag, which is for example reclosable by means of a zipper because the regions of channels or gaps possibly "adhering to one another" due to moisture can no longer ensure a controlled escape of steam and possibly an undesired opening of the zipper can occur so that the steam-cooking effect of the bag is lost.

It was the object of the invention to provide a reliably reclosable bag which is in particular suitable for the steam cooking of packaged food and has a valve for the escape of steam during the cooking process.

SUMMARY OF THE INVENTION

This object is achieved on the one hand by a reclosable bag according to claim 1 and on the other hand by a tool according to claim 10, and by a method according to claim 12.

The subject matter of the invention is therefore a reclosable bag which is suitable for cooking food and which has a device for the escape of steam, consisting of a flexible plastic film or a flexible plastic film composite having an outer and an inner surface, wherein a zipper is provided on the inner surfaces of the plastic film and the two parts of the zipper are fixed on the opposite inner surfaces of the bag and which allows reclosable access to the packaged goods, wherein the zipper is connected to the inner surface of the plastic film in such a manner that between the welded regions between the zipper and the inner surface of the plastic film, recesses are left free in the longitudinal direction of the zipper to form a seal-free longitudinal channel and in the transverse direction of the zipper to produce free air or steam passage openings at defined distances between the zipper and the inner surface, through which openings a passage of steam is possible, wherein the dimension and the geometry of the recesses is coordinated with the internal opening force of the zipper and the bag size insofar as the steam pressure during the cooking does not exceed the force necessary for opening the zipper and wherein ends of the openings facing the interior of the bag are larger than ends of the openings facing the exterior of the bag.

In addition, the subject matter of the invention is a tool for making a connection between a zipper and an inner surface of a plastic film, which is intended as a bag wall of a bag, wherein the tool has sealing zones which are configured to seal a part of the zipper with the inner surface of the plastic film and wherein the sealing zones are interrupted by notches or recesses in the longitudinal direction of the zipper to form a seal-free longitudinal channel and in the transverse direction of the zipper to form free air or steam passage openings at defined distances between the zipper and the inner surface, wherein the dimension and the geometry of the notches or recesses is coordinated with the internal opening force of the zipper and the bag size insofar as the steam pressure during the cooking does not exceed the force necessary for opening the zipper and wherein ends of the openings facing the interior of the bag are larger than ends of the openings facing the exterior of the bag.

Furthermore, the subject matter of the invention is a method for making a connection between a part of a zipper and an inner surface of a plastic film, which is intended as a bag wall of a bag, which method comprises the following process steps, i.e. positioning the part of the zipper on the inner surface of the plastic film and making a connection within the mirror regions between the part of the zipper and the inner surface of the plastic film with the aid of the tool according to the invention.

Due to the measure according to the invention it is advantageously achieved that in the area of the zipper a reliable opening of the device for the escape of steam is ensured. Due to the relatively large configuration of the ends of the openings facing the interior of the bag compared to the ends of the openings facing the exterior of the bag, the glass plate effect is significantly mitigated or completely avoided and the mutually abutting regions of the inner surface of the plastic film and the respective part of the zipper can be separated from one another more easily than if channels or gaps of constant width are provided.

At the same time, due to the relatively small openings in the direction of the bag exterior, it is ensured that the pressure in the interior of the bag required for the steam cooking is maintained. This in turn has a positive effect on the boiling or steam cooking properties of the bag. In addition, due to the combination of recesses in the longitudinal direction and recesses distributed along the longitudinal direction, in the transverse direction, a system of inter-communicating channels is achieved, which ensures that the steam pressure is not concentrated at individual points and there opens the zipper where possible due to a deformation of the bag. On the contrary, the system of channels, for example, allows steam to enter into the system at one position and can exit from the system at different positions. This avoids local stress on the bag and consequently on the zipper because the bag is not deformed at individual points due to the elevated gas pressure. For the steam, the system of channels realises a type of labyrinth into which the steam can enter at different points or positions, can propagate therein and ultimately exit again at different points or positions.

To sum up, the solution according to the invention has as a performance feature worth mentioning the fact that the bag-internal steam pressure is controlled by the passage geometry and the fixing of the zipper on the film inner side of the bag is effected with the aid of a tool for heat sealing which has only minimal modifications compared with the prior art and can be used on a machine (e.g. a conventional stand-up pouch making machine) used to carry out the method of manufacture according to the invention, having known performance and in particular without further adaptations of this machine to the external tool geometry. This is in noteworthy contrast to the known solution in which a reduction of the performance and/or appreciable modifications with reference to the process-relevant steps or with reference to the machine are frequently necessary.

Further, particularly advantageous embodiments and further developments of the invention are obtained from the dependent claims and the following description. The advantages specified in connection with the bag also apply to the subject matter of the tool or to the method of manufacture. Furthermore, the tool or the method of manufacture can be further developed according to the dependent claims for the bag.

The bag according to the invention can be a stand-up pouch or a sachet in conventional, pasteurisable or heat-sterilisable design.

The walls or the base of the bag consist, for example, of a pasteurisable or heat-sterilisable flexible plastic film or a flexible plastic composite.

The zipper is situated on the inner surfaces of the front and rear wall of the bag and fixed by sealing or welding. At the same time, recesses are provided in the sealing seams or weld points under the recesses between the chords of the zipper so that passage of air or steam through these recesses is possible. At the edges the zipper is fixed between the front and rear wall of the bag.

The zipper preferably consists of a heat-resistant material such as HDPE, polyethylene-polypropylene copolymers or polypropylene.

Such zippers are commercially available and exhibit strong toothed properties from inside to outside the bag, whereby an initial resistance is provided when opening the zipper. This ensures that a high steam pressure can be achieved in the package. The asymmetric toothed structure ensures that the zipper can easily be opened from outside.

Said glass plate effect can also be additionally influenced by the choice of the mechanical parameters of the film/films. The tendency towards a pronounced glass plate effect is increased with a soft film whereas the tendency towards a less pronounced glass plate effect is found with a stiffer film. This finding may well be used when selecting the material of the zipper or the base of the zipper which is heat sealed with the sealing layer of the bag. If, for example, polypropylene is used instead of polyethylene, a material having a higher density is used and thus forms a stiffer structure compared to a structure made of polyethylene. The openings of the labyrinth can thus be opened more easily. At the same time, a higher internal opening force of the zipper is obtained. Polypropylene additionally has a higher heat resistance. If ultimately, coordination between the material of the bag film or at least the material of the sealing layer of the bag and the material of the zipper is achieved, i.e. both materials are formed by polypropylene, the bag can also be used for heat sterilisation.

A device for easier opening of the bag such as, for example, by a perforation, in particular a laser perforation, can be achieved above the zipper.

According to one aspect of the invention, the front and rear wall of the bag consists of a plastic film consisting of polypropylene, higher-density polyethylene, or copolymers or blends thereof. The polymer films can also be filled polymer films, for example, polymer films filled with calcium carbonate, $TiO_2$ and the like.

Composites of different plastic films, for example, come into consideration as plastic composite. According to another aspect of the invention, the front and rear wall of the bag consists of a plastic composite film, wherein the outer layer of the composite consists of polyester such as oriented PET, amorphous PET, polyolefins such as polypropylene, cast-PP, blown, stretched, biaxially stretched PP films or polycarbonate, cellophane, polyamide or copolymers thereof. Co-extruded or laminated plastic composite films or composites with paper can also be used. The thickness of the outer layer is, for example, 8-200 μm.

According to a further aspect of the invention, the inner layer consists of polyethylene, EVOH, EVA, (cast) polypropylene and/or copolymers or terpolymers thereof. The inner layer can also be formed by an extrusion coating of the outer film with one of the said plastics. The thickness of the inner layer is preferably 30-100 μm.

FIG. 11 is a cross-sectional view showing a bag comprising a plastic composite film with an inner and an outer layer as just described.

According to one exemplary embodiment of the invention, a boundary interrupted by the longitudinal channel exists between the ends of the openings facing the interior of the bag and the ends of the openings facing the exterior of the bag and this boundary runs rectilinearly.

According to another exemplary embodiment of the invention, a boundary interrupted by the longitudinal channel exists between the ends of the openings facing the interior of the bag and the ends of the openings facing the exterior of the bag and this boundary runs in a curved manner. In this case, for example, a concave or convex shape can be used.

According to a further aspect of the invention, in one exemplary embodiment, the recesses in the transverse direction of the zipper on one inner surface exist at different positions from the recesses in the transverse direction of the zipper on the other inner surface. This can, for example, lead to a zigzag offset structure of recesses in the transverse direction.

According to a further aspect of the invention, in another exemplary embodiment of the invention, the recesses in the transverse direction of the zipper are only formed between the zipper and one of the two inner surfaces.

According to a preferred aspect of the invention, the openings are formed between the zipper and both on the one inner surface and on the other inner surface.

BRIEF DESCRIPTION OF THE FIGURES

The invention is explained once again in detail hereinafter with reference to the appended figures using exemplary embodiments. In different figures the same components are provided with identical reference numbers.

In the figures.

DESCRIPTION OF THE EXEMPLARY EMBODIMENTS

Figure 1:
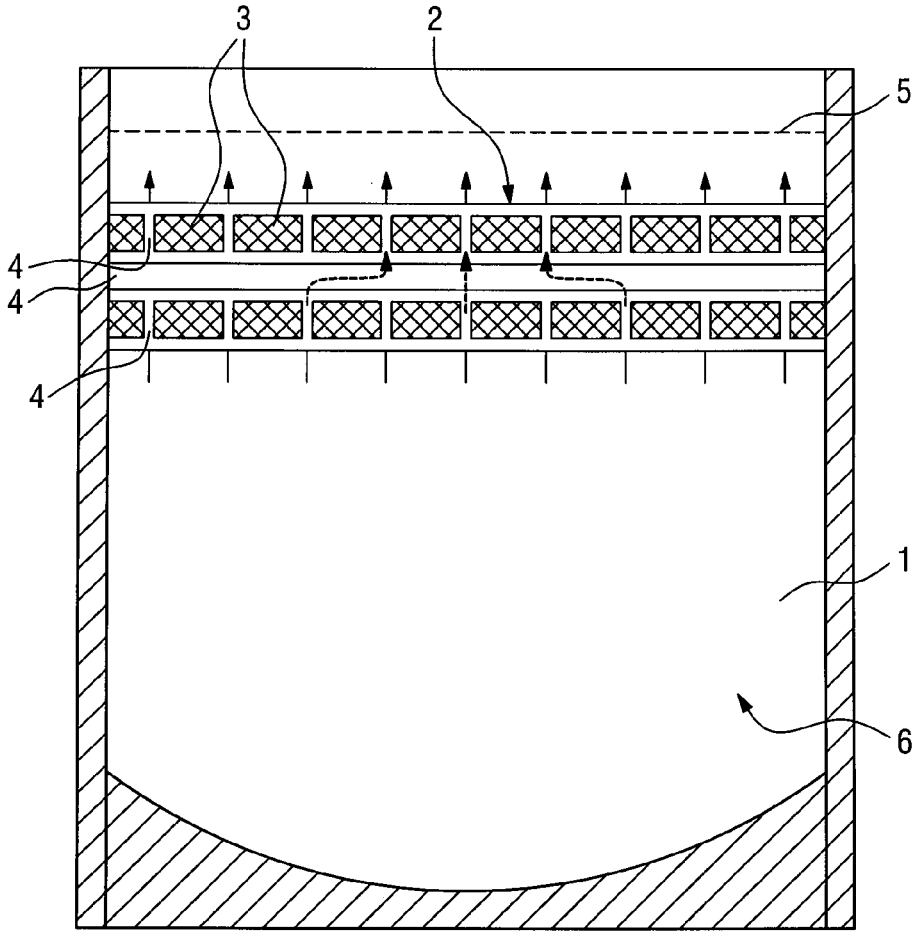
FIG. 1 shows schematically a bag according to the prior art.

FIG. 1 shows a bag. Here, 1 designates the wall of the bag, 2 the zipper, 3 the regions in which the zipper is welded to the inner surface of bag material film of the bag, 4 the recesses between the welded regions, 5 a perforation for opening the bag, and 6 the product.

The bag can first be opened for use along the per-perforated line 5. After opening the zipper 2, liquids, for example, water, spices, and the like can be poured into the bag by the user. The zipper 2 is then closed and the bag heated in a microwave oven. In this case, the filled liquid is heated, steam is produced, and the dry product is cooked. For example, wet (moist) and/or dry foods can be considered as product.

Figure 2:
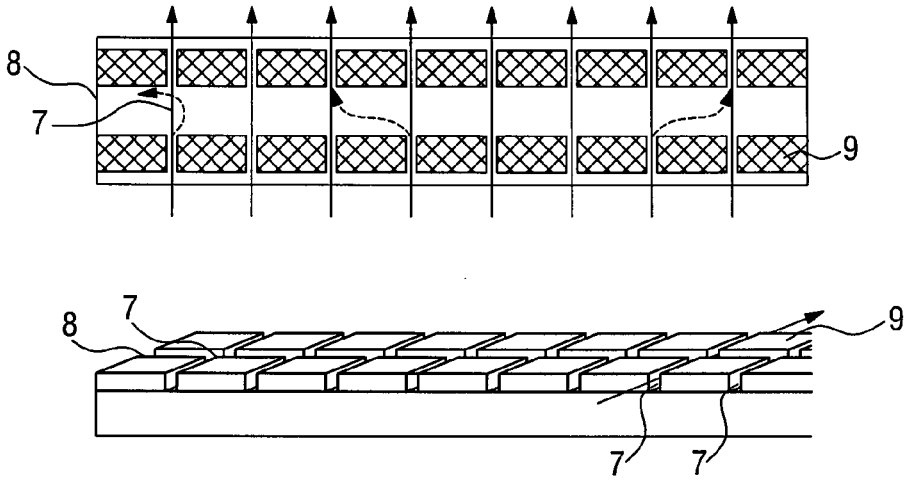
FIG. 2 shows in similar manner to FIG. 1 a part of a tool according to the prior art.

FIG. 2 shows a part of the tool for making the connection between zipper and the inner surface of the bag material film in two perspectives, which has a recess in the longitudinal direction of the zipper 2 to form a seal-free longitudinal channel and in the transverse direction of the zipper 2 to produce the free air or steam passage openings.

In FIG. 2, 7 designates the recesses for forming the air or steam passage openings in the transverse direction of the zipper 2, 8 designates the longitudinal recesses for forming a seal-free longitudinal channel and 9 designates the sealing zones for making a connection between a part of the zipper and the inner surface of the plastic film of the bag.

Figure 3:
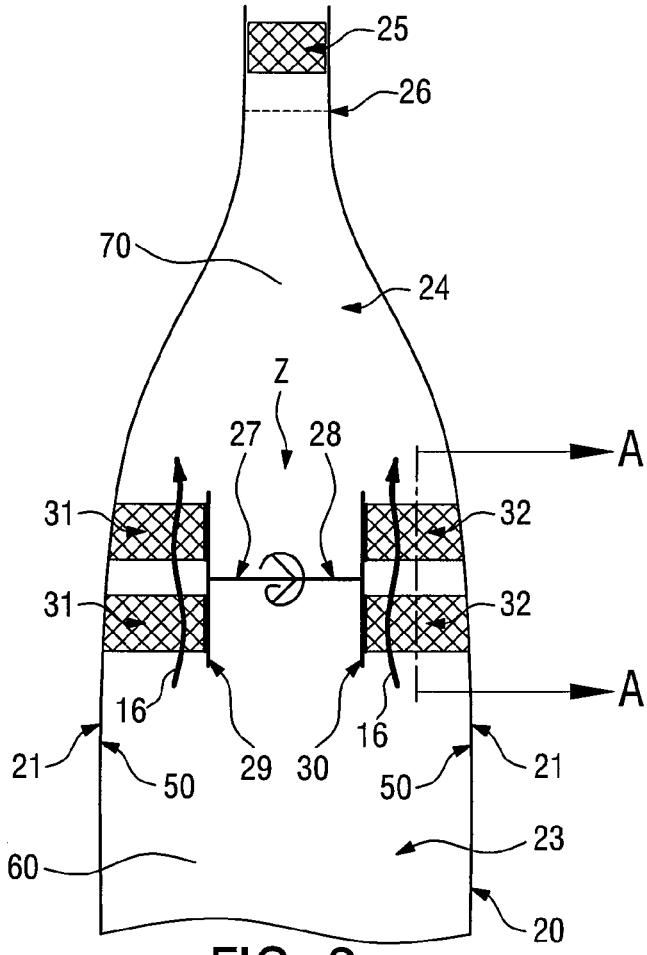
FIG. 3 shows schematically a cross-section through a bag according to one exemplary embodiment of the invention.

FIG. 3 shows a bag 20 according to the invention, more accurately a cross-section through such a bag 20 transverse to the longitudinal direction of the zipper Z. The bag 20 comprises a stand-up pouch which, in the filled state, stands upright of its own accord without further support due to its base geometry. The bag 20 is defined by a wall 21, and has an interior 23. At the top, the bag 20 has a top seal 25. Located underneath the top seal 25 is a tear zone 26 with the aid of which the top seal 25 can be separated. After tearing away the top seal 25 along the tear zone 26, a top region 24 of the bag becomes freely accessible. The zipper Z has a female part 28 and a male part 27. The male part 27 has a first base 29. The female part 28 has a second base 30. The first base 29 is sealed with the inner surface 50 of the plastic film forming the wall 21 in first sealing regions 31. The second base 30 is sealed with said inner surface 50 in second sealing regions 32. The two sealing regions 31 and 32 as well as the zipper Z are shown greatly enlarged. A line or surface of intersection A-A runs through the second sealing regions 32.

Figure 4:
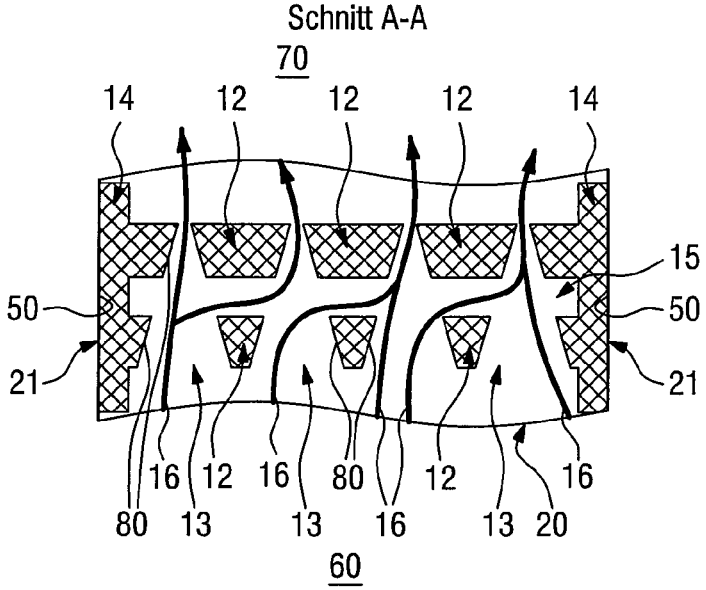
FIG. 4 shows a detail of a sealing zone along a line of intersection A-A plotted in FIG. 3.

A section along this line or surface A-A through the second sealing regions 32 is shown in FIG. 4. The second sealing regions 32 are defined on the one hand by a first recess 15 in the longitudinal direction and by four second recesses 13 in the transverse direction. At the left or right end of the first recesses 15 in the longitudinal direction, respectively one terminating third sealing region 14 can be seen. Also indicated schematically is steam 16 which flows from the bag interior 23 in the direction of the top region 24 through the channel system of the second sealing region 32. It can also be clearly seen how the steam 16 carves an optimal path through the labyrinth of the channel system, wherein steam entering into the labyrinth at one point/position need not necessarily exit from the labyrinth at the same point/position in the transverse direction of the zipper Z but can leave the labyrinth via adjacent exit points. The relatively large inlet openings in the area of the bag interior 23 allow easy opening of the ends of the labyrinth facing the interior 60 of the bag 20 during the heating and the release of steam 16, and consequently allow a problem-free inflow of steam 16 into the labyrinth. At the same time, the relatively narrow or small outlet openings in the direction of the top region 24, i.e. the ends of the labyrinth facing the exterior 70, of the bag 20 allow the steam pressure required for the cooking to be maintained in the bag interior 23. The steam 16 entering into the labyrinth can propagate optimally in the labyrinth and exit from the labyrinth in a problem-free manner so that the risk of steam concentration at individual points, and therefore also a pressure concentration and associated deformation of the bag 20 at these points, is reliably avoided and consequently no unnecessary stress is exerted on the intermeshed male and female parts 27 or 28 of the zipper Z. As a result, an undesirable partial or extensive opening of the zipper Z is reliably avoided.

Figure 5:
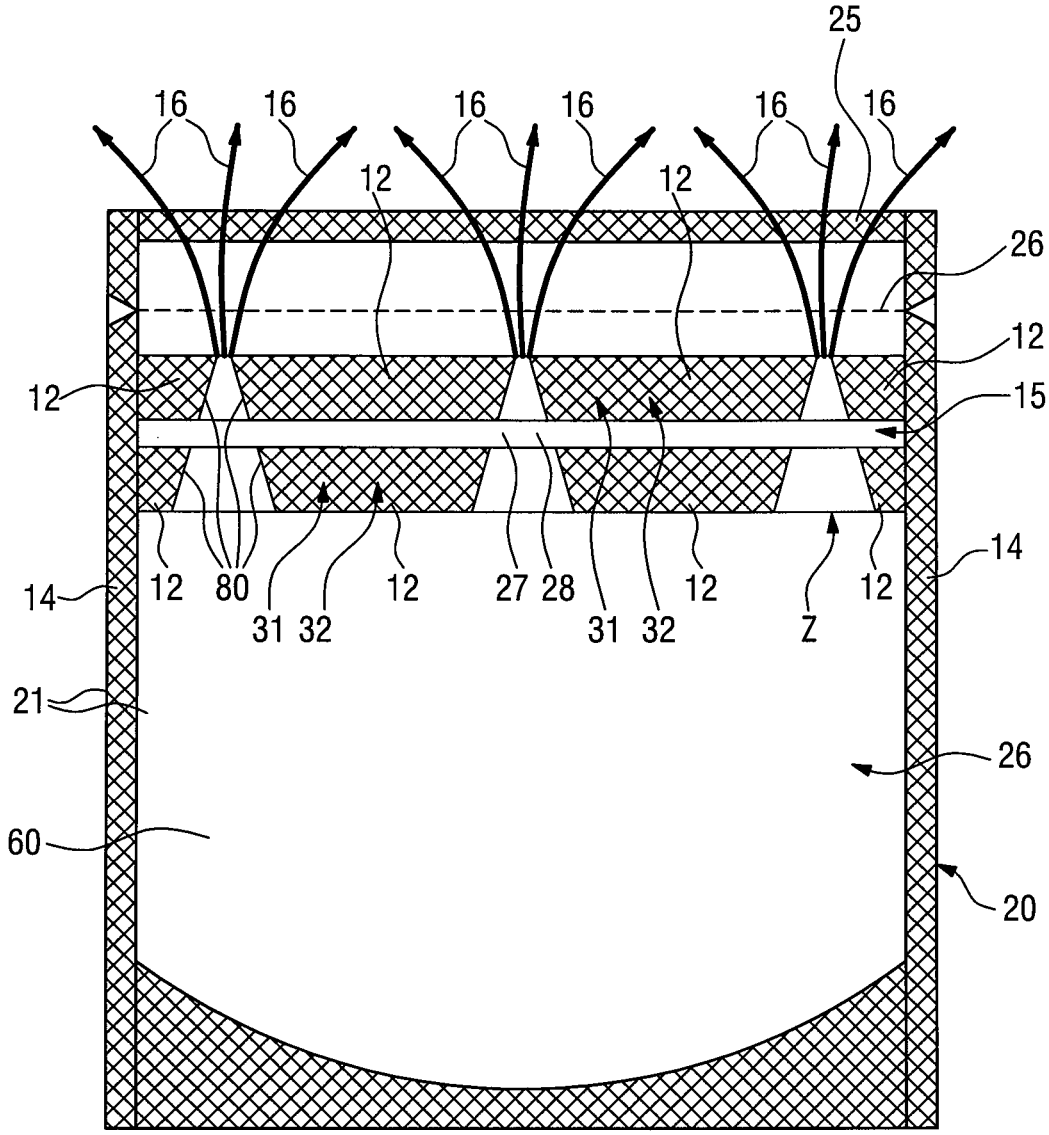
FIG. 5 shows in similar manner to FIG. 3 a bag according to the invention in a frontal view.

FIG. 5 further shows a further exemplary embodiment of a bag 20 according to the invention in frontal view onto the front side of the bag 20. The zipper Z is only shown roughly schematically indicated by its boundaries and is shown substantially transparently in order to make the labyrinth located thereunder visible. The first recess 15 in the longitudinal direction of the zipper Z, running substantially underneath the respective male part 27 or the female part 28 of the zipper Z can be clearly seen. In the present case, a first base 29 projects from the plane of the drawing. In the present case, three second recesses 13 in the transverse direction of the zipper Z can be clearly seen, said recesses having in the direction of the bag interior 23 (the ends of the labyrinth facing the interior 60 of the bag 20) substantially larger inflow openings than in the direction of the top region 24 (the ends of the labyrinth facing the exterior 70). The third sealing regions 14 define the first recess 15 in the longitudinal direction of the bag 20 and at the same time form the longitudinal sealing seams of the bag 20. The steam 16 flowing out from the openings of the labyrinth facing the top region 24 is shown schematically. It is unnecessary to say that this steam 16 can naturally only exit from the bag 20 when the top of the bag 20 has been torn away along the tear zone 26, which in the present case was produced by a laser weakening of the film of the bag 20.

Figure 6:
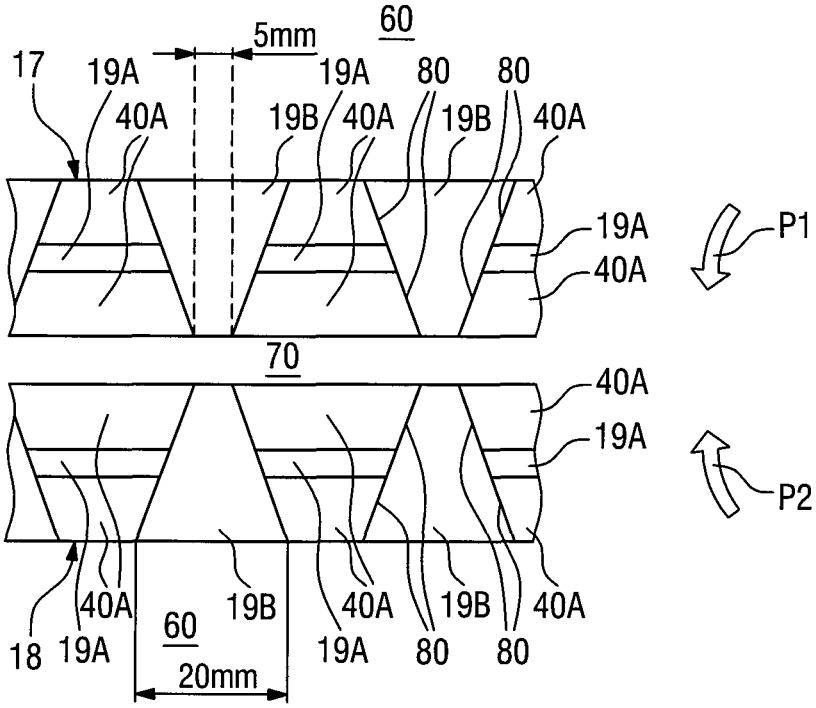
FIG. 6 shows schematically a section of a two-part tool according to the invention according to one exemplary embodiment of the invention.
Figure 7:
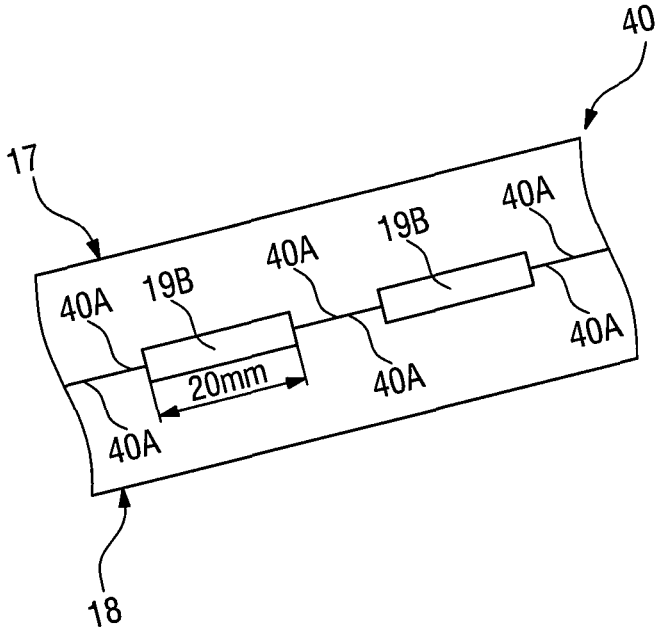
FIG. 7 shows the tool according to FIG. 6 in a joined-together configuration.

FIG. 6 shows the tool 40 for making the connection between the base 29 of the part 27 or the base 30 of the part 28 of the zipper Z and the inner surface of the plastic film of the bag 20. This tool 40 has a first tool part 17 and a second tool part 18 which are configured substantially symmetrically to one another and have mutually corresponding sealing zones 40A by which means the first sealing regions 11 shown in FIG. 3 or 4 and the second sealing regions 12 can be achieved. The longitudinal notch or longitudinal recess 19A located between the sealing zones 40A, by which means the first recess 15 is formed in the longitudinal direction of the zipper Z can be clearly seen. The two tool parts 17 and 18 are joined together in use (cf. arrows P1 and P2), as shown in FIG. 7, so that the sealing zones 40A are located opposite one another and the plastic film or the respective male part 27 or the female part 28 positioned on the plastic film are located between said sealing zones. Due to the action of pressure and heat, the first base 29 or the second base 30 are finally connected to the inner surface of the plastic film so that the first sealing region 31 or the second sealing region 32 are formed with the structure of the recesses 15 and 13. Transverse notches or transverse recesses 19B run in the transverse direction to the longitudinal notch 19A, which substantially form a triangular structure with a truncated vertex or in other words a truncated-cone transverse structure and are provided to form the second recesses 13 in the transverse direction of the zipper Z. The transverse notches 19B formed between the first base 29 or the second base 30 therefore have a conical tapering from the bag interior 23 towards the top region 24, with the result that a valve effect is formed which counteracts the escape of the steam 16.

The dimension and the geometries of the recesses are coordinated with the internal opening force of the zipper Z and the bag size insofar as the steam pressure during cooking does not exceed the force required to open the zipper Z.

For example, in the case of a bag size of 200×140 mm having a zipper with a 12/25 N/50 mm opening force, respectively three triangular openings having a width of 20/5 mm are provided on the front side and on the rear side of the bag. The larger width dimension always relates to the product direction of the opening. In the case of relatively large openings, however, a zipper having an opening force of 7.5/18 N/50 mm can preferably be used. In the case of relatively small openings a zipper having an opening force of 12/27 N/50 mm is preferred. With reference to the specification of the opening force of the zipper, it should be explained at this point that the notation, e.g. 12/25 N/50 mm should be understood such that a force of 12 N per 50 mm must act on the zipper from outside the bag in order to open this whereas a force of 25 N per 50 mm must act on the zipper from inside the bag to open this.

Figure 8:
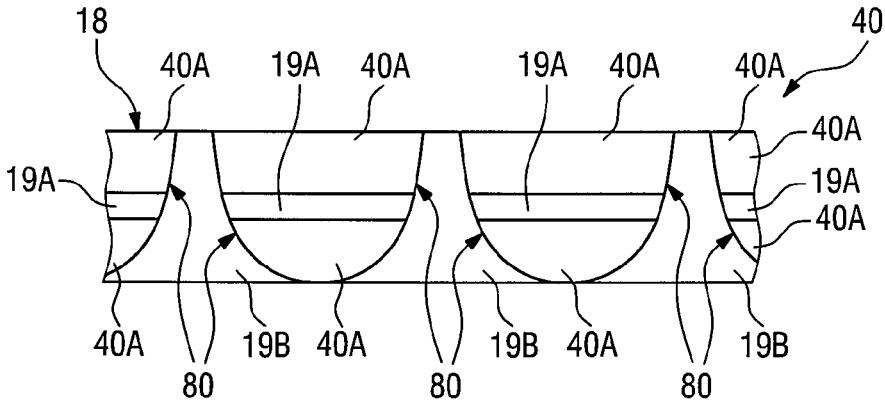
FIGS. 8 to 10 shows various configurations of transverse notches for different exemplary embodiments of the tool according to the invention.
Figure 9:
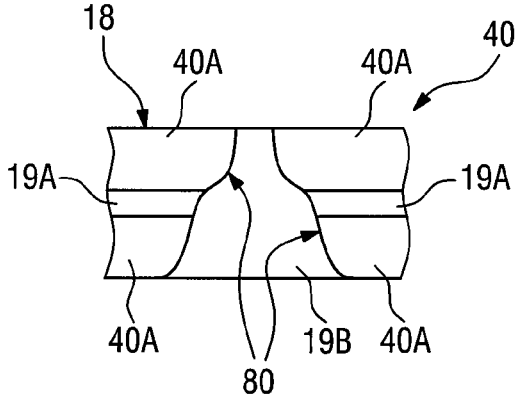
Figure 10:
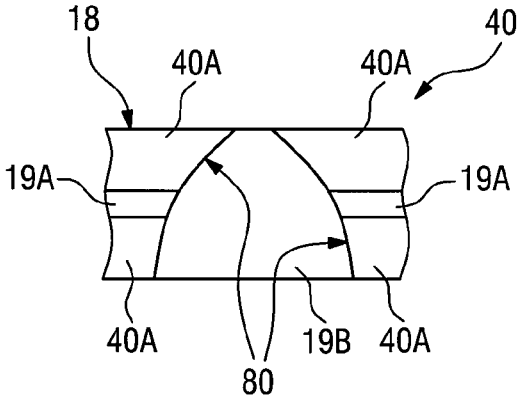
Figure 11:
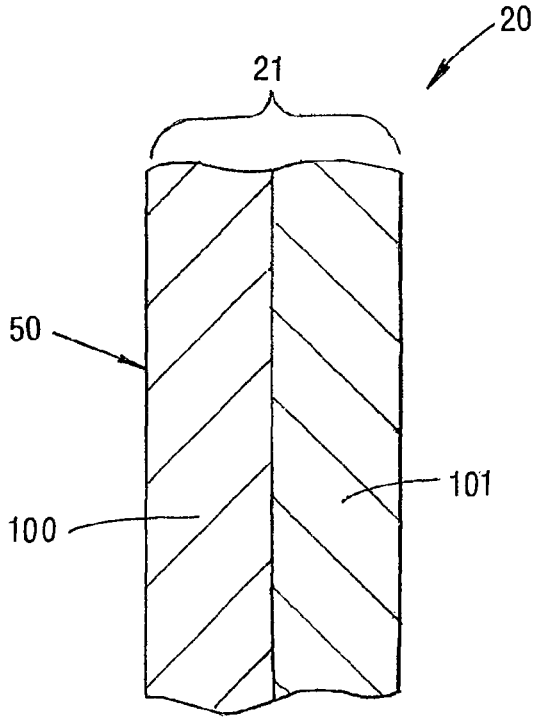
FIG. 11 is a cross-sectional view showing a bag 20 comprising a plastic composite film with an inner layer 100 and an outer layer 101.

It should, however, also be mentioned at this point that the form of the tapering is not rectilinear but can also follow a curve as shown in FIGS. 8 to 10. Step-like structures having sharp edges can also be used.

It should also be mentioned that the first sealing region 31 and the second sealing region 32 need not be provided at identical points. On the contrary, the second recesses 13 in the transverse direction of the zipper Z formed in the respective sealing region 31 or 32 can also exist at different points in relation to the male part 27 and the female part 28, which possibly contributes to a better stress reduction in the area of the zipper Z. It should likewise be mentioned that also only one of the sealing regions 31 or 32 can have said second recesses 13 in the transverse direction of the zipper Z.

Finally, it should once again be noted that the bag described in detail hereinbefore and the tool shown and the method merely comprise exemplary embodiments which can be modified by the person skilled in the art in various ways without departing from the range of the invention. For the sake of completeness it is also pointed out that the use of the indefinite article "a" or "one" does not exclude the fact that the relevant features can also be multiply present.

The invention claimed is:

1. A reclosable bag which is suitable for cooking food and which has a device for the escape of steam, comprising a flexible plastic film or a flexible plastic film composite having an outer and an inner surface, wherein a zipper having two parts is provided on the inner surface of the plastic film and the two parts of the zipper are fixed on the opposite inner surface of the bag and the zipper allows reclosable access to the packaged goods, wherein the zipper is connected to the inner surface of the plastic film by welded regions in such a manner that between the welded regions between the zipper and the inner surface of the plastic film, recesses are left free in the longitudinal direction of the zipper to form a seal-free longitudinal channel and in the transverse direction of the zipper to produce free air or steam passage openings at defined distances between the zipper and the inner surface, through which openings a passage of steam is possible, and wherein ends of the openings facing the interior of the bag are larger than ends of the openings facing the exterior of the bag, and said openings taper from the interior to the exterior of the bag, with the exterior end of each opening being disposed centrally over the interior end of the corresponding opening.

2. The reclosable bag according to claim 1, characterised in that the front and rear wall of the bag consist of a plastic film consisting of at least one of polypropylene, higher-density polyethylene, and copolymers or blends thereof.

3. The reclosable bag according to claim 1, characterised in that the front and rear wall of the bag consist of a plastic composite film, wherein the outer layer of the composite film consists of at least one polyester selected from the group consisting of oriented PET, amorphous PET, polyolefins such as polypropylene, cast-PP, blown, stretched, biaxially stretched PP films or polycarbonate, cellophane, polyamide and copolymers thereof.

4. The reclosable bag according to claim 3, characterised in that the inner layer consists of polyethylene, EVA, polypropylene and/or copolymers or terpolymers thereof.

5. The reclosable bag according to claim 1, wherein a boundary of the welded region interrupted by the longitudinal channel exists between the ends of the openings facing the interior of the bag and the ends of the openings facing the exterior of the bag and this boundary runs rectilinearly.

6. The reclosable bag according to claim 1, wherein a boundary of the welded region interrupted by the longitudinal channel exists between the ends of the openings facing the interior of the bag and the ends of the openings facing the exterior of the bag and this boundary runs in a curved manner.

7. The reclosable bag according to claim 1, wherein the recesses in the transverse direction of the zipper on one inner surface exist at different positions from the recesses in the transverse direction of the zipper on the other inner surface.

8. The reclosable bag according to claim 1, wherein the recesses in the transverse direction of the zipper are only formed between the zipper and one of the two inner surfaces.

9. The reclosable bag according to claim 1, wherein the openings are formed between the zipper and both of the one inner surface and the other inner surface.

10. The reclosable bag according to claim 3, wherein the outer layer comprises a plurality of layers of said polyester, and further comprises aluminum foil.

11. A reclosable bag which is suitable for cooking food and which has a device for the escape of steam, comprising a flexible plastic film or a flexible plastic film composite having an outer and an inner surface, wherein a zipper having two parts is provided on the inner surface of the plastic film and the two parts of the zipper are fixed on the opposite inner surface of the bag and the zipper allows reclosable access to the packaged goods, wherein the zipper is connected to the inner surface of the plastic film by welded regions in such a manner that between the welded regions between the zipper and the inner surface of the plastic film, recesses are left free in the longitudinal direction of the zipper to form a seal-free longitudinal channel and in the transverse direction of the zipper to produce free air or steam passage openings at defined distances between the zipper and the inner surface, through which openings a passage of steam is possible, and wherein ends of the openings facing the interior of the bag are larger than ends of the openings facing the exterior of the bag, and wherein the exterior end of each opening is disposed centrally with respect to the interior end of the corresponding opening.

12. A reclosable bag which is suitable for cooking food and which has a device for the escape of steam, comprising a flexible plastic film or a flexible plastic film composite having an outer and an inner surface, wherein a zipper having two parts is provided on the inner surface of the plastic film and the two parts of the zipper are fixed on the opposite inner surface of the bag and the zipper allows reclosable access to the packaged goods, wherein the zipper is connected to the inner surface of the plastic film by welded regions in such a manner that between the welded regions between the zipper and the inner surface of the plastic film, recesses are left free in the longitudinal direction of the zipper to form a seal-free longitudinal channel and in the transverse direction of the zipper to produce free air or steam passage openings at defined distances between the zipper and the inner surface, through which openings a passage of steam is possible, and wherein ends of the openings facing the interior of the bag are larger than ends of the openings facing the exterior of the bag, and wherein both longitudinal ends of the exterior end of each opening are spaced inwardly from the corresponding longitudinal ends of the interior end of the corresponding opening.

* * * * *